United States Patent [19]

Reed

[11] Patent Number: 4,470,602

[45] Date of Patent: Sep. 11, 1984

[54] BOARD GAME HAVING PIECES WHICH CHANGE MODE ON EACH MOVE

[76] Inventor: Charles F. Reed, 1260 NW. 116th Ter., North Miami, Fla. 33168

[21] Appl. No.: 383,770

[22] Filed: Jun. 1, 1982

[51] Int. Cl.[3] ..... A63F 3/00

[52] U.S. Cl. ..... 273/260; 273/288

[58] Field of Search ..... 273/260–262, 273/243, 255, 291, 288, 242, 248, 258, 281

[56] References Cited

U.S. PATENT DOCUMENTS

| | | | |
|---|---|---|---|
| 3,642,286 | 2/1972 | Moore | 273/291 |
| 3,929,337 | 12/1975 | Hayes | 273/260 |
| 4,213,615 | 7/1980 | Price | 273/260 |

*Primary Examiner*—Richard C. Pinkham
*Assistant Examiner*—Matthew L. Schneider
*Attorney, Agent, or Firm*—Erwin M. Barnett

[57] ABSTRACT

A game is played on the playing surface of a board divided into at least three rows of squares with identical pieces except for player distinguishing markings, each piece being cubic in shape and having each of the three pairs of opposite sides thereof marked with distinguishing insignia. Each insignia designates a mode or characteristic to be assumed by the piece when the side of the cube faces upwardly. The rules provide details for playing a game utilizing such board and pieces in which the three modes are characterized as aggressive, impregnable and vulnerable.

4 Claims, 8 Drawing Figures

BOARD GAME HAVING PIECES WHICH CHANGE MODE ON EACH MOVE

BACKGROUND OF THE INVENTION

1. Field of the Invention

This invention relates to a board game having a playing surface of squares of equal size and substantially identical pieces having indicia designating three modes or characteristics of play and a set of rules for moving the pieces from square to square in such manner as to change mode on each move for the ultimate purpose of capturing and removing all the opponents pieces.

2. Description of the Prior Art

Various modifications have been made of conventional chess and checker games. In the case of checkers, many changes introduce more variations and interest in the game, while in the case of chess, an element of chance has been provided or arrangements made for four players rather than two. Also, the popular geometric form of the cube has often been adopted as a playing piece utilizing each of the six sides either with the dot markings of the conventional die or by other indicia in playing the game. Examples of prior art games utilizing the cube are represented by U.S. Pat. Nos. 3,588,114, 3,642,286, 3,908,999 and 3,929,337.

SUMMARY OF THE INVENTION

Among the objects of the invention is to provide a game for playing on a simple board divided into squares of equal size with pieces all of which are identical except for opponent distinguishing marks. The game features pieces and board which are simple in construction and inexpensive to manufacture in quantity production and three modes or characteristics capable of being assumed by each of the pieces and the predictable changing from one mode to another as the piece is moved from square to square on the board. The three modes, namely, impregnability, vulnerability and aggressiveness, embody relatively simple characteristics or properties as compared to other board game moves. These modes when utilized in accordance with equally simple, easy-to-learn rules provide a challenging game requiring just enough reasoning and advanced planning of moves to be exciting and hold the players' interest yet not be so complicated as to discourage beginners or become tedious.

The game comprises a board having at least three rows of squares, each row having a suitable number of squares to accommodate the set of pieces provided for each of the two players of the game. All the pieces of both sets may be cubes which are sized to fit within the board squares, each cube having three pairs of opposite surfaces bearing three distinguishing indices designating each of the three modes. The index appearing on the upfacing surface of the cube may serve to designate the mode of the particular piece. In accordance with the rules, each move of a piece to an adjacent square includes a 90° rotation of the piece to present another upfacing surface bearing a different index thereby designating a different mode.

DESCRIPTION OF THE PREFERRED EMBODIMENT

Figure 1:
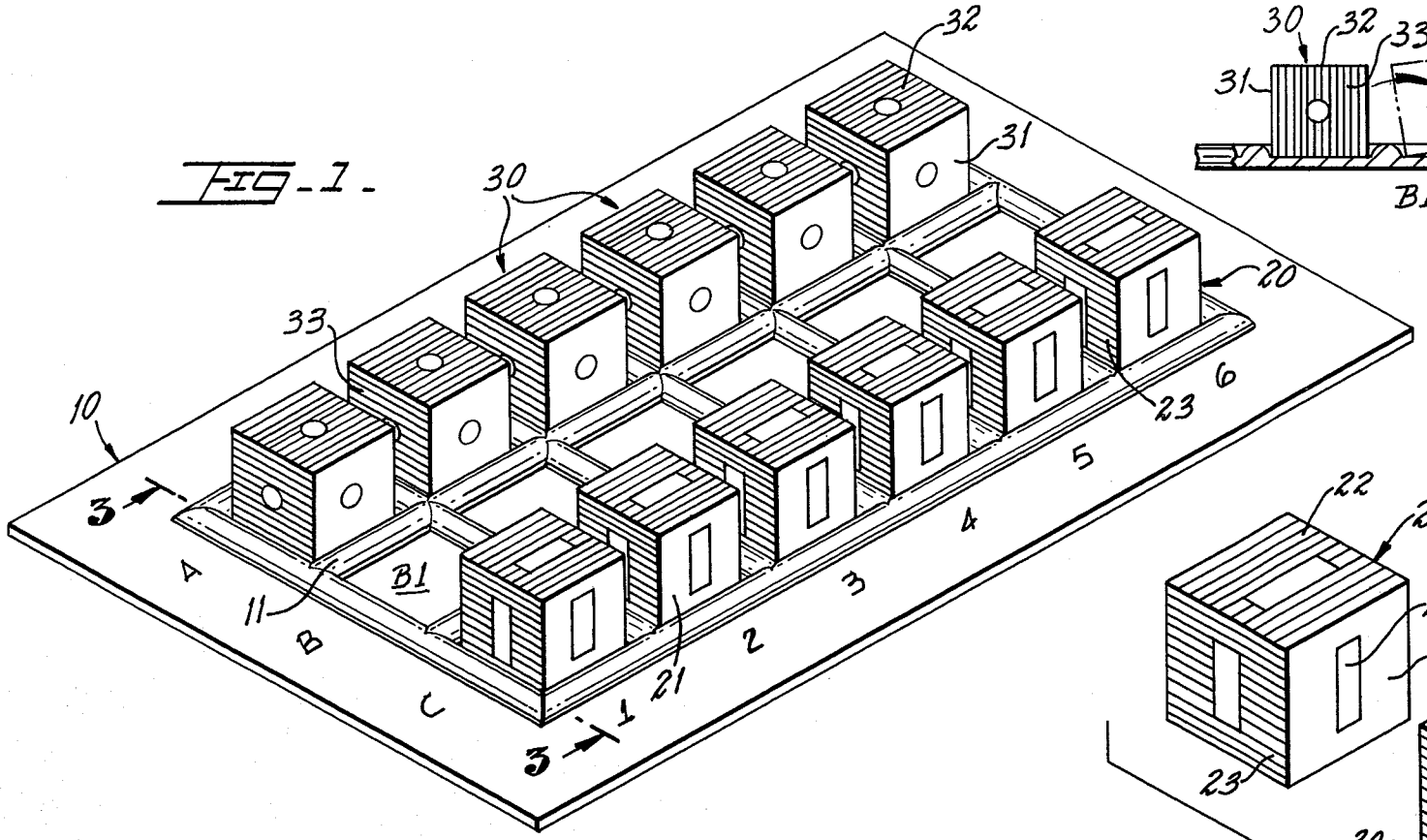
FIG. 1 is a perspective view of the game board and pieces embodying the invention, the pieces, in the form of cubes, being shown in their setup position for starting the game.

Referring in detail to the drawings, 10 denotes a game board on which one player's pieces 20 and the other player's pieces 30 are moved in playing the game in accordance with the invention. In the embodiment illustrated herein, game board 10 comprises three rows of squares, each row having six squares. For reference purposes, each square has a row and square designation, the row designation, beginning at the rear as seen in FIG. 1, being A, B and C, the squares in each row being designated 1 to 6, inclusive, beginning at the left. Thus, the leftmost square in the middle row is square B1. The orientation of pieces 20 and 30 with respect to the front and side of board 10 being significant in playing the game, proper alignment of the pieces 20 and 30 may be maintained by suitable dividing ridges 11 which surround each square.

Figure 2:
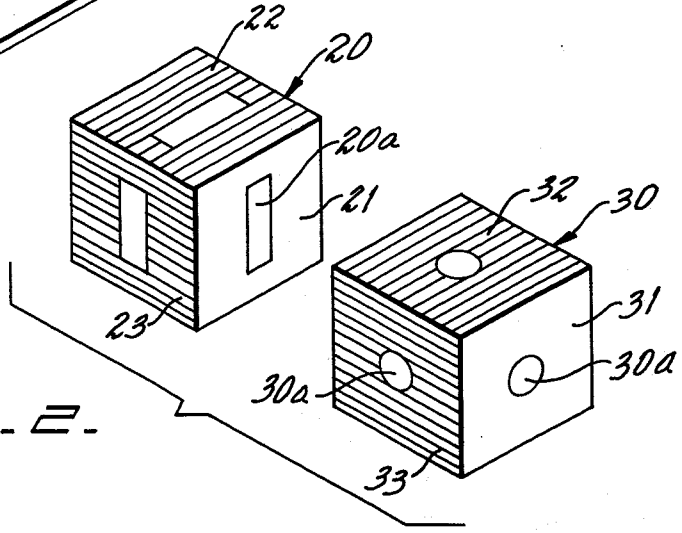
FIG. 2 is a perspective view of a cube of each of the two sets of pieces, the bar or dot, which appears on all six sides of each cube, serving as a mark for distinguishing the set of cubes of each of the two players. The exposed right side of each cube is shown as white, the upfacing sides lined for blue and the left facing sides are lined for red.

Pieces 20 and 30, which are in the form of cubes and hereinafter referred to as such, are identical except for opponent distinguishing indicia shown in FIG. 2 as a bar **20*a* on each of the six faces of cubes 20, and a dot 30*a* on each of the six faces of cubes 30**.

A feature of the invention is the simplicity of the pieces, each being cubic in form providing three pairs of opposite sides or faces, each pair being designated to establish one of three possible modes or characteristics of the piece when the particular side is upfacing in its position on the square. For this purpose color designation may be utilized, the pair of opposite sides 21 and 31 being white, sides 22 and 32 being blue and sides 23 and 33 of cubes 20 and 30, respectively, being red. Although the colors may be chosen and given their respective mode designations arbitrarily, the choices herein of red as aggressive, white as impregnable and blue as vulnerable are suggestive of these modes.

The practical utility of the invention will be apparent within the framework of the following rules.

DEFINITIONS

Aggressive mode, designated by red, imparts to the cube the ability to take opponent's cube which is either in the aggressive or vulnerable mode but incapable of acting against the impregnable mode.

Vulnerable mode, designated by blue, imparts to the cube the capability of being taken by the opponent's cube when the latter is in the aggressive mode, but lacks the ability of taking any of the opponent's cubes.

Impregnable mode, designated by white, imparts to the cube the characteristic of resisting opponent's cubes in the aggressive mode but otherwise being incapable of taking the opponent's cubes.

INITIAL LINEUP

The two players are each initially allotted a set of six cubes 20 or 30. As seen in FIG. 1, cubes 30 of one set are positioned on the six squares of row A and cubes 20 of the other set are positioned in row C. The initial placement or orientation of each of the cubes 20 and 30 on the respective squares is identical and, as dictated by the rules, the blue sides 22 and 32 face upwardly and downwardly, the white sides 21 and 31 face toward the front and rear and the red sides 23 and 33 face toward the right and left.

PLAYING RULES

Figure 3:
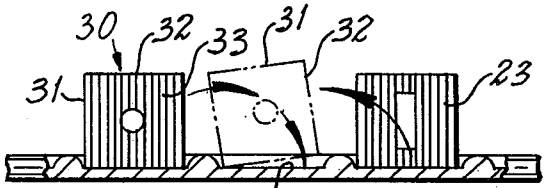
FIG. 3 is a sectional view taken through the game board on line 3—3 in FIG. 1, the cube in phantom showing the manner of movement of the cube on the left by 90° rotation in the direction of movement into the adjacent square, and FIGS. 4 to 8, inclusive, are fragmentary perspective views showing the positions of the cubes at progressive stages of a game embodying the invention described herein.

A cube may move in any direction into any unoccupied adjacent square, that is, to the right or left or forwardly or rearwardly, but not diagonally. The move is accomplished by a 90° rotation of the cube in the direction of movement. Thus, as will be clear from FIG. 1 and as shown in FIG. 3, the leftmost cube 30 in row A may move into the vacant adjacent square B1 as indicated in phantom whereby the 90° rotation places white side 31 in an upfacing position to change the mode from vulnerable to impregnable.

The players determine the first to move by any suitable procedure, such as, by the toss of a coin or the toss of a die. The game proceeds by each player taking his turn until the game ends when one player becomes the winner by removing, that is, taking, all his opponent's cubes from the board or by such opponent's remaining cube or cubes being blocked so as to render the opponent incapable of completing his turn.

A player's turn constitutes moving one of his cubes into an adjacent unoccupied square with an option of moving that same cube a second time into another adjacent square but not back to the original position. The move may also be accomplished by taking an opponent's cube positioned in an adjacent square when the taking cube is in the aggressive mode and the cube being taken is either in the aggressive or vulnerable mode. A cube may also be taken on the optional move.

The prohibition against moving back to the original square as the optional move does not apply when the first move takes a cube. Thus, after taking a cube on the first move a player has the following three choices: (1) remaining on the square after taking and not exercising the option of moving a second time, (2) returning to the original square, or (3) moving to another adjacent square which may include taking a second cube.

A player must take his opponent's cube whenever possible on the first move of such player's turn and is penalized for not doing so by the loss of the cube when the oversight is called before the opponent completes his next turn.

When a player has but one cube remaining, the game is a draw after a prearranged number of turns, for example, after 10, 25 or 50 turns.

The following move by move description of a game will illustrate the rules and highlight the features of the invention. Dot, winning the toss, moves first.

| | | | |
|---|---|---|---|
| | | 1. | |
| Dot | A2 blue | B2 | B1 red |
| Bar | C5 blue | B5 | B6 red |

The notation of moves will be clear from the following explanation of turn 1, above. As initially lined up in FIG. 1, dot's cube in square A2, mode blue, moves to square B2 and then to square B1 becoming mode red. The taking of a cube is indicated by enclosing the square designation of the taken cube in parenthesis as in turn 2, below, wherein dot in square B1, mode red, takes the cube in square C1 and then returns to square B1. In turn 3, bar does not take the optional second move, choosing to remain in square A5, mode white.

| | | | |
|---|---|---|---|
| | | 2. | |
| Dot | B1 red | (C1) | B1 red |
| Bar | B6 red | (A6) blue | |
| | | 3. | |
| Dot | A5 blue | B5 | B6 red |
| Bar | A6 blue | A5 white | |
| | | 4. | |
| Dot | B6 red | (C6) | C5 white |
| Bar | C4 blue | B4 | B3 red |
| | | 5. | |
| Dot | B1 red | B2 white | |
| Bar | B3 red | (A3) | B3 red |

Figure 4:
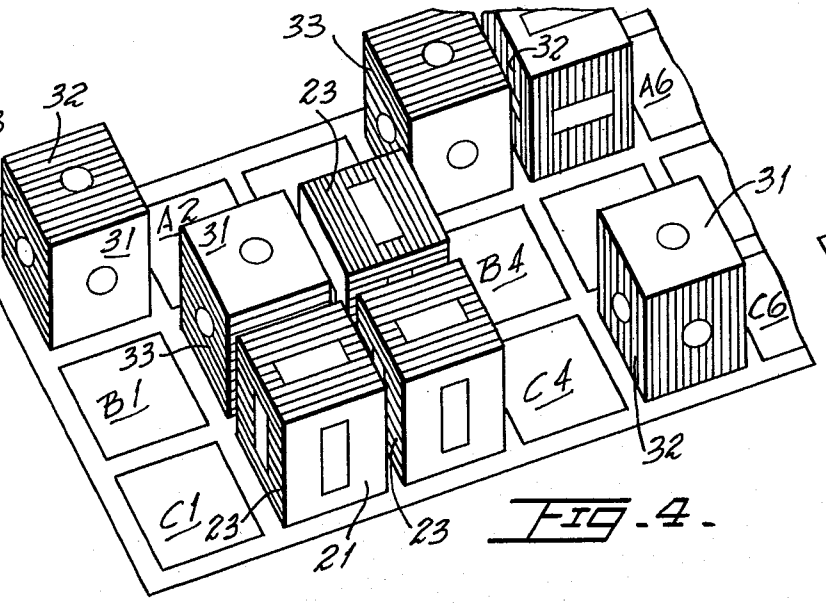

FIG. 4 shows the board at this point in the game. Bar, by returning to B3 after taking the cube in A3, made a bad move leading to the loss of that cube in turn 6 and thus became the turning point of the game in dot's favor.

| | | | |
|---|---|---|---|
| | | 6. | |
| Dot | A4 blue | A3 | (B3) white |
| Bar | A5 white | A4 | A3 white |
| | | 7. | |
| Dot | B3 white | B4 | A4 red |
| Bar | C3 blue | B3 white | |
| | | 8. | |
| Dot | C5 white | C4 | B4 red |
| Bar | C2 blue | C1 | B1 white |
| | | 9. | |
| Dot | B2 white | C2 | C3 red |
| Bar | A3 white | A2 blue | |

Figure 5:
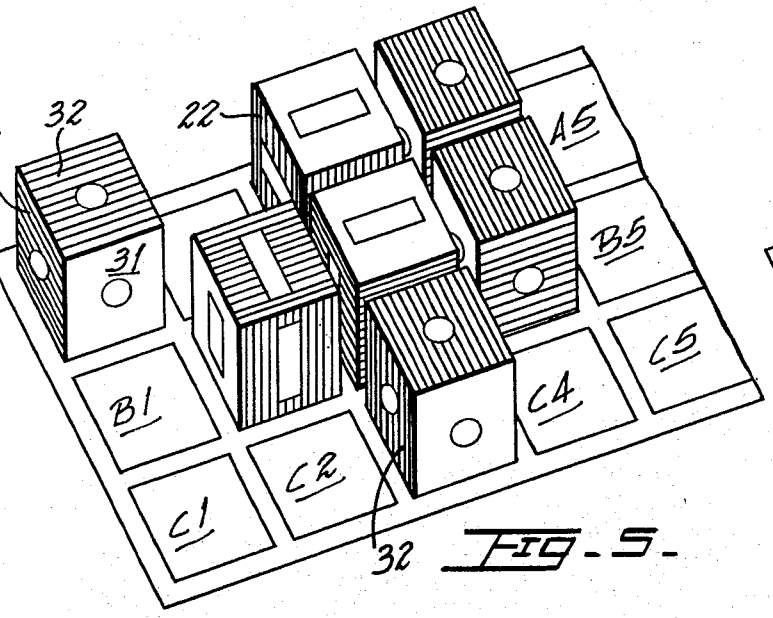

The board at this point is shown in FIG. 5. In turn 9, by moving into B2 to attack dot's cubes in both A1 and C3, bar overlooked the fact that the attact against dot A1 works both ways resulting in bar's loss of the cube in turn 10.

| | | | |
|---|---|---|---|
| | | 10. | |
| Dot | A1 blue | A2 | (B2) white |
| Bar | A3 white | A2 blue | |
| | | 11. | |
| Dot | C3 red | C2 blue | |
| Bar | B3 white | C3 blue | |
| | | 12. | |
| Dot | C2 blue | C1 | B1 white |
| Bar | C3 blue | C4 | (B4) white |

Figure 6:
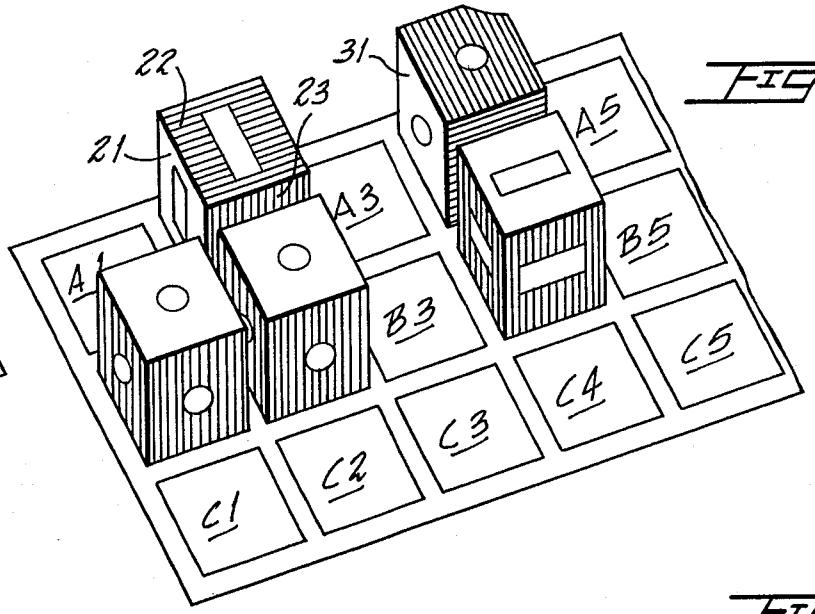

The board at this point is shown in FIG. 6. After turn 13, bar will be left with only one cube and the rule limiting the game to a prearranged number of turns after which a draw is called becomes effective. In this game the number of turns agreed upon was 10 turns.

| | | | |
|---|---|---|---|
| | | 13. | |
| Dot | B1 white | A1 | (A2) blue |
| Bar | B4 white | B5 | B6 white |

-continued

| | | | |
|---|---|---|---|
| | | 14. | |
| Dot | B2 white | B3 | B4 white |
| Bar | B6 white | B5 blue | |
| | | 15. | |
| Dot | A4 red | A5 white | |
| Bar | B5 blue | C5 | C4 white |
| | | 16. | |
| Dot | A2 blue | B2 white | |
| Bar | C4 white | C3 | B3 blue |
| | | 17. | |
| Dot | A5 white | A4 | A3 white |
| Bar | B3 blue | C3 | C2 white |
| | | 18. | |
| Dot | B4 white | B3 | C3 red |
| Bar | C2 white | C1 | B1 blue |

Figure 7:
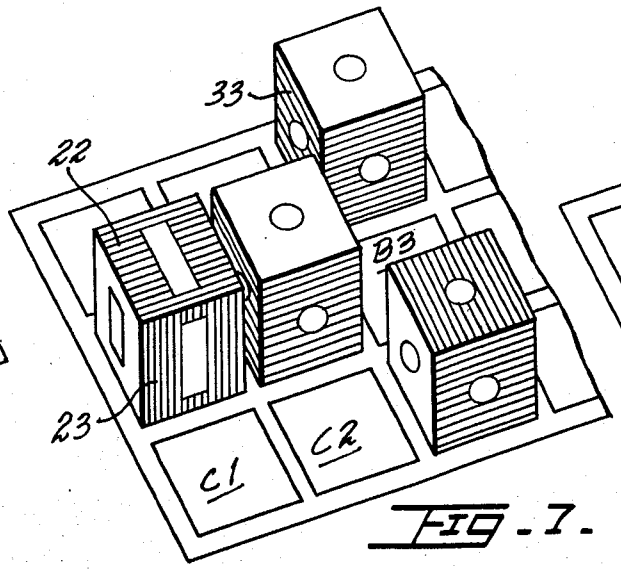

The board at this point is shown in FIG. 7.

| | | | |
|---|---|---|---|
| | | 19. | |
| Dot | C3 red | C2 white | |
| Bar | B1 blue | A1 | A2 white |
| | | 20. | |
| Dot | C2 white | C1 red | |
| Bar | resigns | | |

Figure 8:
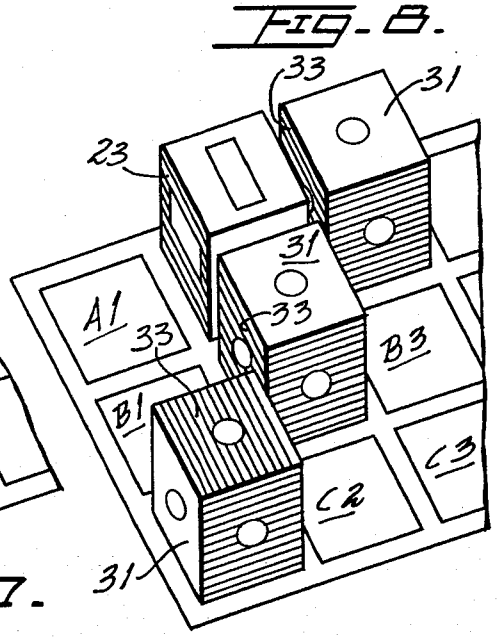

The board being shown at this point in FIG. 8, it is clear that bar has only two possible moves, namely, to advance to B1 where dot C1 will take or to stop at A1 where dot A3 will take. This move by move game clearly illustrates the challenges and interest generated by the uncomplicated rules and extreme simplicity of board and pieces embodying the invention.

It is contemplated, within the scope of the invention, that any suitable symbols, indicia or other identifying markings be employed to distinguish at a glance the cubes of each set instead of the dots 30*a* and bars 20*a*, and to designate the three modes instead of the overall colors. For example, the set designation can be an overall color, such as black and white or red and white, and selected symbols centralized on each face as mode designations.

Inasmuch as it is important when playing the game that the mode designations appearing on the vertical sides of each cube be easily visible to both players, an overall color or pattern for this purpose is preferable to a single centralized symbol. Cubes 20 and 30 may be made of wooden blocks or of molded plastic material as hollow structures.

The board game herein disclosed is seen to achieve the several objects of the invention and to be well adapted to meet conditions of practical use. As various possible embodiments might be made of this invention, and as various changes might be made in the disclosed game, it is understood that all matters herein set forth or shown in the accompanying drawings are to be interpreted as illustrative and not in a limiting sense.

What is claimed is:

1. A game played by two players on a board having solely three rows of a predetermined number of equally sized squares, a set of pieces for each player, the pieces of each of said sets being cubes sized to fit within each board square, all of said cubes being substantially identical in surface markings, except for indicia for distinguishing between the two sets, said surface markings comprising three pairs of mode indicia, each pair being located on opposite faces of the cube, the particular mode indicium appearing on the upfacing face of the cube as positioned on a square designating the mode characteristic of the cube with the other indicia on the vertical faces visible to both players, the three mode characteristics being aggressive wherein the cube can be taken or can take, vulnerable wherein the cube can be taken, and impregnable wherein the cube cannot be taken, each move of a cube to an adjacent square by including a 90° rotation of the cube in the direction of movement effecting a predictable change of mode.

2. The game defined in claim 1 in which each set of pieces correspond in number to said predetermined number of squares in each of said rows.

3. The game defined in claim 2 in which said predetermined number of squares is six.

4. The game defined in claim 1 in which said mode indicia are each overall patterns covering substantially the entire surface area of the cube face and said indicia for distinguishing between the two sets of cubes are relatively small symbols centralized on each face.

* * * * *